US005398576A

United States Patent [19]

Chiu

[11] Patent Number: 5,398,576

[45] Date of Patent: Mar. 21, 1995

[54] CUTTING DEVICE FOR A ROLL OF PROTECTIVE FILM

[76] Inventor: Kuang-Wu Chiu, No. 92, Se. 1, Chung-Cheng Rd., Tung-Kang Chen, Ping-Tung Hsien, Taiwan, Prov. of China

[21] Appl. No.: 209,000

[22] Filed: Mar. 9, 1994

[51] Int. Cl.[6] ..... B26D 5/10

[52] U.S. Cl. ..... 83/614; 83/455; 83/649

[58] Field of Search ..... 83/455, 614, 649

[56] References Cited

U.S. PATENT DOCUMENTS

| | | | |
|---|---|---|---|
| 2,393,384 | 1/1946 | Kress | 83/614 |
| 3,137,192 | 6/1964 | McNeill | 83/614 X |
| 4,197,774 | 4/1980 | Singh et al. | 83/455 X |
| 4,787,284 | 11/1988 | Chen | 83/614 |
| 5,036,740 | 8/1991 | Tsai | 83/455 |

*Primary Examiner*—Richard K. Seidel
*Assistant Examiner*—Raymond D. Woods
*Attorney, Agent, or Firm*—Ladas & Parry

[57] ABSTRACT

A cutting device for a roll of protective film includes an elongated positioning unit which has two side walls, a top wall interconnecting the top ends of the side walls so as to define a sliding space among the side and top walls, and a longitudinally extending slot formed through the top wall and communicated with the sliding space. A cutter includes a sliding body placed on the positioning unit and having a rear portion and a front portion which has a rearwardly and downwardly inclined front end surface and a notch formed in the bottom surface thereof. A blade is mounted in the notch and extends rearwardly and downwardly from the sliding body in such a manner that the cutting edge of the blade is aligned with the front end surface of the sliding body. A guide unit includes two vertical plates projecting downwardly from the rear portion of the sliding body through the slot of the positioning unit, and two horizontal plates that project outwardly from lower ends of the vertical plates. The length of the vertical plates is slightly longer than the thickness of the top wall of the positioning unit so that the front portion of the sliding body can turn somewhat upwardly to facilitate cutting of the protective film by the cutting edge of the blade.

3 Claims, 3 Drawing Sheets

CUTTING DEVICE FOR A ROLL OF PROTECTIVE FILM

BACKGROUND OF THIS INVENTION

1. Field of the Invention

This invention relates to a cutting device for a roll of protective film, more particularly to a cutting device which can conveniently and effectively cut a roll of protective film.

2. Description of the Related Art

This invention is an improvement of a conventional cutting device, shown in FIG. 1, which is used for cutting a roll of protective film 15 that is disposed within an elongated box 10. The cutting device includes a positioning unit 1 and a cutter 2 that is mounted slidably on the positioning unit 1. The box 10 has an elongated outlet portion 20 which is located at one of the sides of the top surface of the box 10 so as to permit pulling of the protective film 15 out of the box 10.

Referring to FIGS. 1 and 2, the positioning unit 1 includes two aligned and elongated vertical side walls 11 which are mounted securely on the other side of the top surface of the box 10 at the bottom ends thereof, an elongated horizontal top wall 12 which interconnects the top ends of the side walls 11 so as to define an elongated sliding space 13 between the side walls 11 and under the top wall 12, and a longitudinally extending slot 14 formed through the top wall 12 and communicated with the sliding space 13.

The cutter 2 includes a sliding body 21 which is disposed on the top surface of the top wall 12 of the positioning unit 1, a blade 22 (see FIG. 2) which is mounted vertically and securely on the bottom surface of the sliding body 21 and which extends through the slot 14, and a guide unit which includes a pair of vertical guide plates 23 (only one is shown) that are mounted respectively and securely on the bottom ends of two opposite side walls of the sliding body 21 and that extend downwardly along the outer surface of the respective side wall 11 of the positioning unit 1 so as to retain the cutter 2 on the positioning unit 1.

When it is desired to cut the protective film 15, a user has to draw one end of the protective film 15 from the outlet portion 20 of the box 10 and press the same against the top surface of the top wall 12 of the positioning unit 1. The blade 22 cuts the protective film 15 when the sliding body 21 is pushed along the slot 14 from one end to the other end of the latter. However, when the cutter 2 is in use, the guide plates 23 may touch the protective film 15 first and thus wrinkle the protective film 15, as shown in FIG. 1. Accordingly, it is difficult for the blade 22 of the cutter 2 to cut the wrinkled portion of the protective film 15. The conventional cutting device is thus inconvenient to use.

SUMMARY OF THIS INVENTION

The main objective of this invention is to provide a cutting device which is used to cut a roll of protective film and which can conveniently and effectively cut the same.

According to this invention, a cutting device which is used for cutting a roll of protective film includes a positioning unit and a cutter. The positioning unit has two aligned and elongated vertical side walls, an elongated horizontal top wall which interconnects the top ends of the side walls so as to define an elongated sliding space between the side walls and under the top wall, and a longitudinally extending slot formed through the top wall and communicated with the sliding space. The cutter includes a sliding body which is placed on the top surface of the top wall of the positioning unit. The sliding body has a rear portion and a front portion which has a rearwardly and downwardly inclined front end surface and a notch that is formed in a bottom surface of the front portion. The cutter further includes a blade which is mounted securely on the sliding body in the notch and which extends rearwardly and downwardly from the sliding body in such a manner that the cutting edge of the blade is aligned with the front end surface of the front portion of the sliding body, and a guide unit which includes two vertical plates that project downwardly from the bottom surface of the rear portion of the sliding body through the slot of the top wall of the positioning unit, and two horizontal plates that project respectively and outwardly from the lower ends of the vertical plates under the top wall of the positioning unit. The slot of the top wall of the positioning unit is sized so as to prevent removal of the guide unit from the positioning unit. The length of the vertical plates is slightly longer than the thickness of the top wall of the positioning unit so that, when the cutting edge of the blade contacts the protective film, the front portion of the sliding body can turn somewhat upwardly to facilitate cutting of the protective film by the cutting edge of the blade.

BRIEF DESCRIPTION OF THE DRAWING

Other features and advantages of this invention will become apparent from the following detailed description of a preferred embodiment of this invention, with reference to the accompanying drawings, in which.

DETAILED DESCRIPTION OF THE PREFERRED EMBODIMENT

Figure 4:
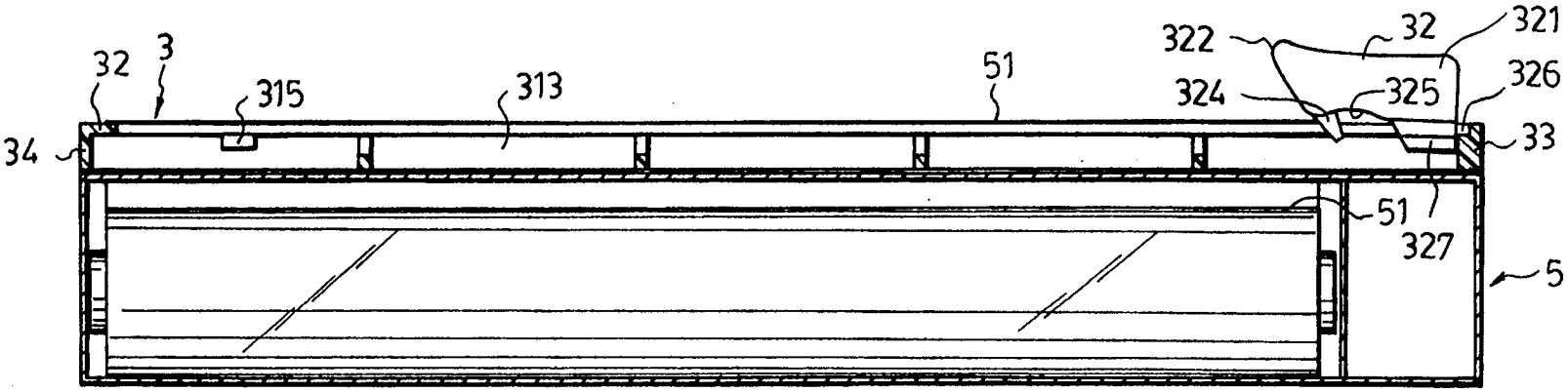
FIG. 4 is a schematic view of the preferred embodiment.

Referring to FIG. 4, a cutting device 3 of the preferred embodiment of this invention is used to cut a roll of protective film 51 that is disposed within an elongated box 5 in a known manner. The cutting device 3 is mounted securely on the top surface of the box 5 and includes a positioning unit 31 and a cutter 32.

Figure 1:
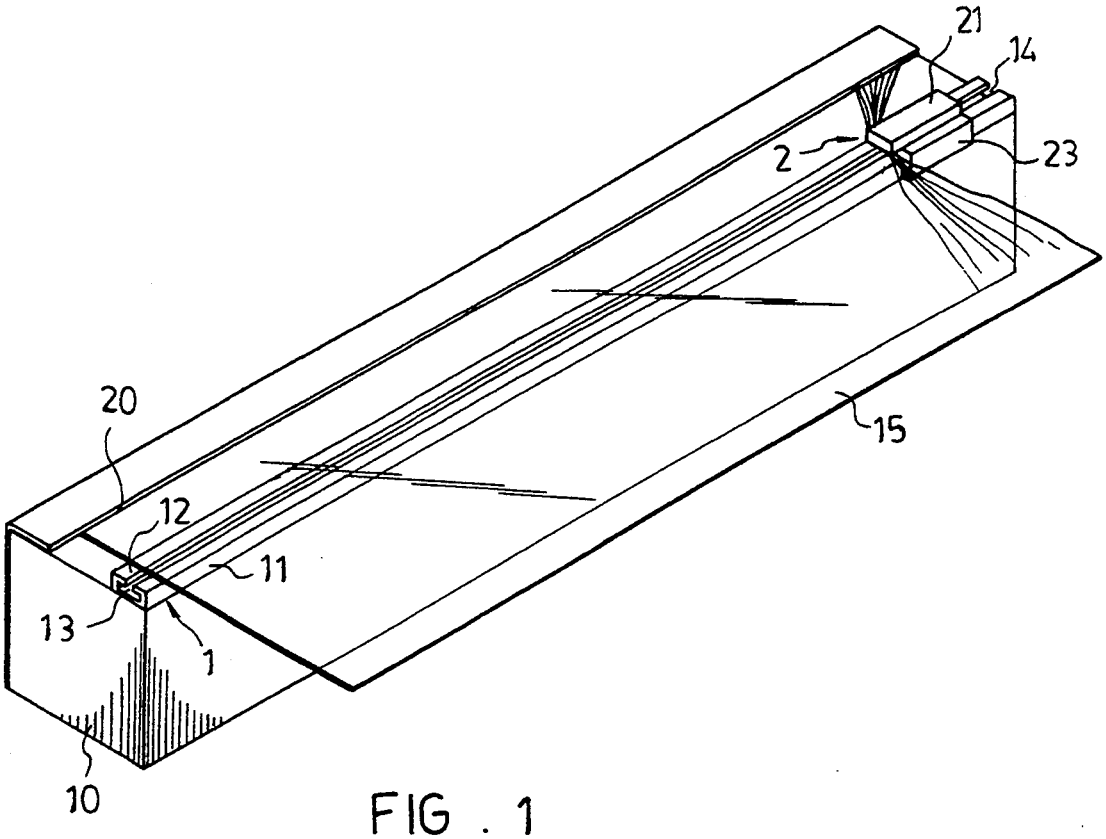
FIG. 1 (PRIOR ART)
FIG. 1 is a perspective view of a conventional cutting device which is used for cutting a roll of protective film.
Figure 2:
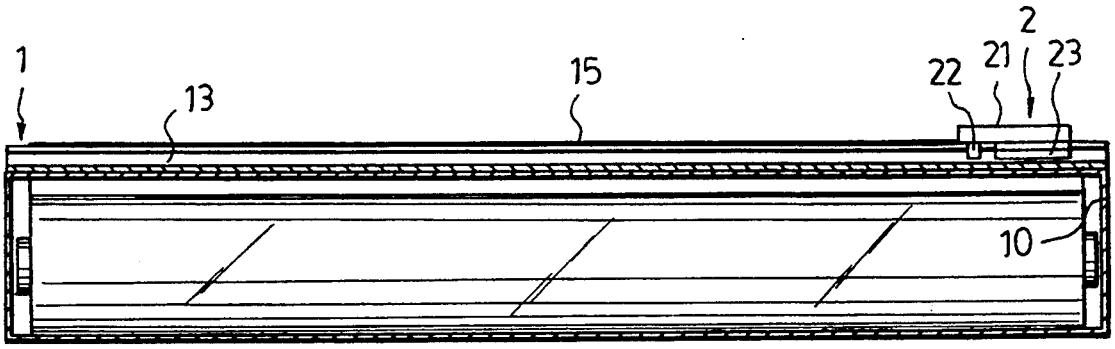
FIG. 2 (PRIOR ART)
FIG. 2 is a schematic view illustrating the conventional cutting device.
Figure 3:
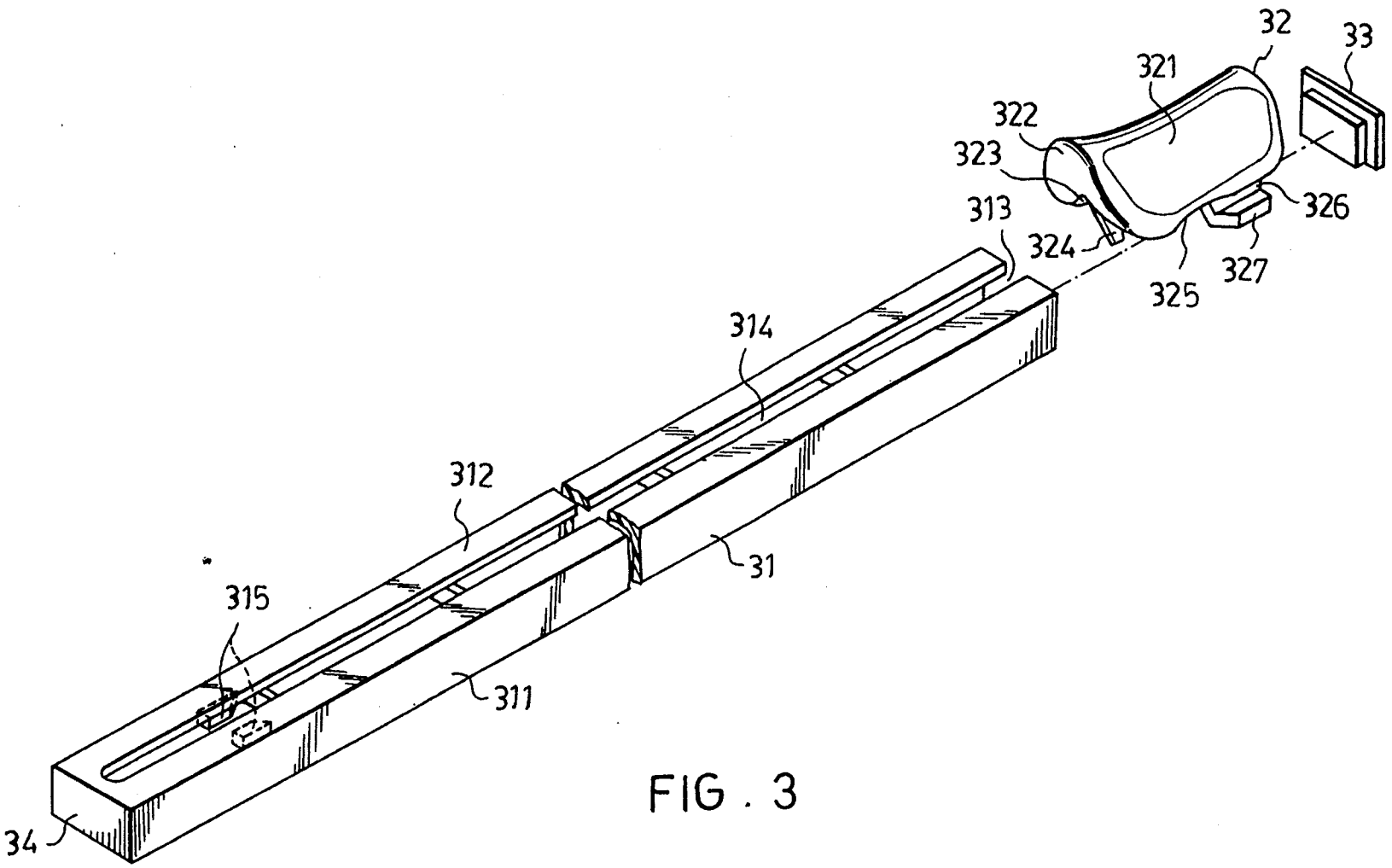
FIG. 3 is an exploded view showing a cutting device of the preferred embodiment of this invention.

Referring to FIG. 3, the positioning unit 31 has two aligned and elongated vertical side walls 311 (only one is shown) which are secured to the top surface of the box 5 (see FIG. 4) at the bottom ends thereof, an elongated horizontal top wall 312 which interconnects the top ends of the side walls 311 so as to define an elongated sliding space 313 between the side walls 311 and under the top wall 312, and a longitudinally extending slot 314 formed through the top wall 312 and communicated with the sliding space 313. The positioning unit 31 further includes an upright front stop plate 34 which is mounted securely on the front end portions of the side and top walls 311, 312 of the positioning unit 31, and an upright rear stop plate 33 which is mounted removably on the rear end portions of the side and top walls 311, 312 of the positioning unit 31 so as to permit removal of the cutter 32 from the positioning unit 31.

Referring to FIGS. 3 and 4, the cutter 32 includes a sliding body 321 which is placed on the top surface of the top wall 312 of the positioning unit 31. The sliding body 321 has a rear portion and a front portion which has a rearwardly and downwardly inclined front end surface 322 and a notch 323 that is formed in the bottom surface thereof. The cutter 32 further includes a blade 324 which is mounted securely on the sliding body 321 in the notch 323 and which extends rearwardly and downwardly from the sliding body 321 in such a manner that the cutting edge of the blade 324 is aligned with the front end surface 322 of the front portion of the sliding body 321. A guide unit includes two vertical plates 326 that project downwardly from the bottom surface of the rear portion of the sliding body 321 through the slot 314 of the top wall 312 of the positioning unit 31, and two horizontal plates 327 that project respectively and outwardly from the lower ends of the vertical plates 326 under the top wall 312 of the positioning unit 31. The slot 314 of the top wall 312 of the positioning unit 31 is sized so as to prevent removal of the guide unit from the positioning unit 31, thereby retaining the cutter 32 on the positioning unit 31. The length of the vertical plates 326 is slightly longer than the thickness of the top wall 312 of the positioning unit 31. Accordingly, when the cutting edge of the blade 324 contacts the protective film 51 (see FIG. 4), the front portion of the sliding body 321 can turn somewhat upwardly so as to facilitate cutting of the protective film 51 by the cutting edge of the blade 324. The sliding body 321 of the cutter 32 further has a curved concave portion 325 on a bottom surface thereof between the blade 324 and the guide unit so as to prevent contact between the bottom surface of the sliding body 321 and the portion of the protective film 51 which has been cut off. Owing to being located at the rear portion of the sliding body 321, the guide unit of the cutter 32 can prevent wrinkling of the protective film 51 when the cutter 32 is in use so that the blade 324 can easily cut the protective film 51.

Figure 5:
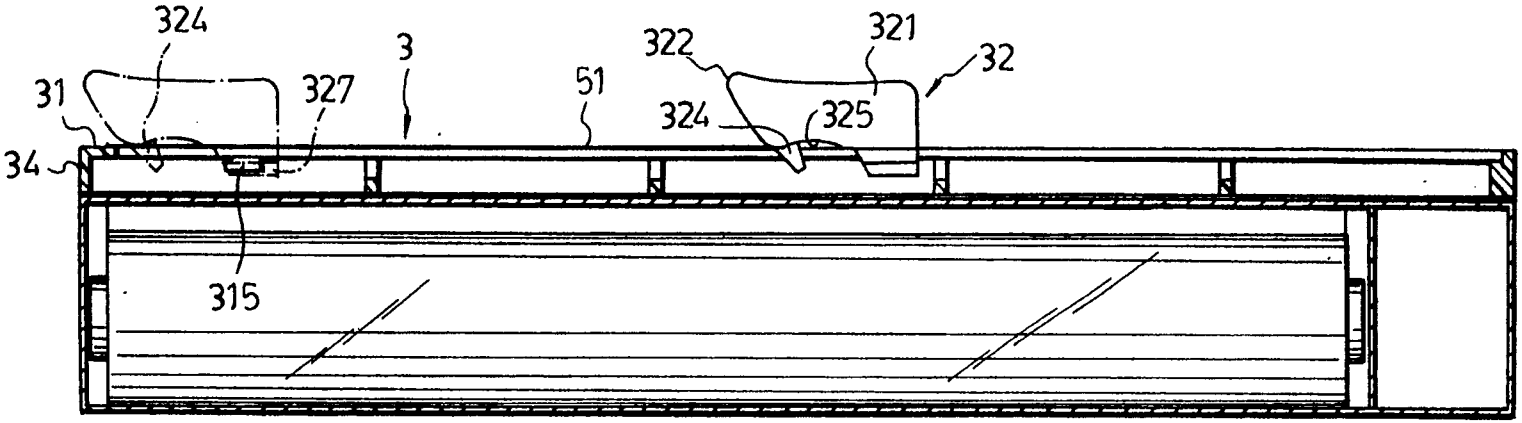
FIG. 5 is a schematic view illustrating how the cutting device is operated so as to cut a roll of protective film in accordance with the preferred embodiment of this invention.

The positioning unit 31 further includes a pair of stop blocks 315 which are secured in the sliding space 313 of the positioning unit 31 near the front end portion of the side and top walls 311, 312 of the positioning unit 31. Accordingly, when the cutter 32 is in use, the stop blocks 315 can block respectively the horizontal plates 327 of the guide unit of the cutter 32 from forward movement, as shown in FIG. 5, thereby preventing the cutting edge of the blade 324 from colliding with the front stop plate 34.

With this invention thus explained, it is apparent that numerous modifications and variations can be made without departing from the scope and spirit of this invention. It is therefore intended that this invention be limited only as indicated in the appended claims.

I claim:

1. A cutting positioning unit comprising: a positioning unit having two aligned and elongated vertical side walls, an elongated horizontal top wall which interconnects top ends of said side walls so as to define an elongated sliding space between said side walls and under said top wall, and a longitudinally extending slot formed through said top wall and communicated with said sliding space; and a cutter including a sliding body which is placed on a top surface of said top wall of said positioning unit, said sliding body having a rear portion and a front portion which has a rearwardly and downwardly inclined front end surface and a notch formed in a bottom surface thereof, said cutter further including a blade which is mounted securely on said sliding body in said notch and which extends rearwardly and downwardly from said sliding body in such a manner that a cutting edge of said blade is aligned with said front end surface of said front portion of said sliding body, and a guide unit which includes two vertical plates that project downwardly from the bottom surface of said rear portion of said sliding body through said slot of said top wall of said positioning unit, and two horizontal plates that project respectively and outwardly from lower ends of said vertical plates under said top wall of said positioning unit, said slot of said top wall of said positioning unit being sized so as to prevent removal of said guide unit from said positioning unit, said vertical plates having a length longer than a thickness of said top wall of said positioning unit so that, when said cutting edge of said blade contacts a material to be cut said front portion of said sliding body is capable of turning upwardly so as to facilitate cutting of the material by said cutting edge of said blade; said sliding body having a curved concave portion in the bottom surface thereof between said blade and said guide unit so as to prevent contact between said bottom surface of said sliding body and a portion of said material which has been cut-off.

2. The cutting positioning unit as claimed in claim 1, further comprising an upright front stop plate which is mounted securely on front end portions of said side and top walls of said positioning unit, and an upright rear stop plate which is mounted removably on rear end portions of said side and top walls of said positioning unit so as to permit removal of said cutter from said positioning unit.

3. The cutting positioning unit as claimed in claim 2, wherein said positioning unit further includes a pair of stop blocks secured in said sliding space of said positioning unit near said front end portions of said side and top walls of said positioning unit so that, when said cutter is in use, said stop blocks are capable of blocking respectively said horizontal plates of said guide unit of said cutter from forward movement to prevent said cutting edge of said blade from colliding with said front stop plate.

* * * * *